US011517124B2

(12) United States Patent
Sok

(10) Patent No.: US 11,517,124 B2
(45) Date of Patent: Dec. 6, 2022

(54) INFANT MOBILITY SCOOTER AND ASSOCIATED METHOD FOR SOOTHING AN INFANT USING THE SAME

(71) Applicant: Chollana Sok, Hudsonville, MI (US)

(72) Inventor: Chollana Sok, Hudsonville, MI (US)

( * ) Notice: Subject to any disclaimer, the term of this patent is extended or adjusted under 35 U.S.C. 154(b) by 0 days.

(21) Appl. No.: 17/094,998

(22) Filed: Nov. 11, 2020

(65) Prior Publication Data

US 2022/0142376 A1 May 12, 2022

(51) Int. Cl.
*A47D 13/04* (2006.01)

(52) U.S. Cl.
CPC ..... *A47D 13/04* (2013.01)

(58) Field of Classification Search
CPC ..... A47D 13/04; A47D 15/008; A47D 13/08; A47D 15/001; A47D 13/043; B62K 9/00; A61G 2200/14; A61G 5/00; A61H 3/04; B25H 5/00
See application file for complete search history.

(56) References Cited

U.S. PATENT DOCUMENTS 1,572,273 A * 2/1926 Elton ..... A47D 13/08 280/87.051
3,044,797 A * 7/1962 Borland ..... A61G 5/00 280/87.051
3,532,356 A 10/1970 Lillibridge
3,992,023 A 11/1976 Moorer
4,207,879 A 6/1980 Safadago et al.
4,569,532 A 2/1986 Mirkarimi
5,046,750 A * 9/1991 Heubl ..... B62K 9/00 482/68
5,333,769 A 8/1994 Skroski
5,639,105 A 6/1997 Summo
5,675,853 A * 10/1997 Linge ..... A47D 13/08 5/655
6,817,864 B1 11/2004 Martinez
7,182,351 B2 * 2/2007 Williams ..... A47D 13/04 280/32.6
8,038,158 B1 10/2011 White
(Continued)

FOREIGN PATENT DOCUMENTS

CN 201602470 10/2010
CN 206390663 U * 8/2017
(Continued)

OTHER PUBLICATIONS

Translated KR-20120043544-A (Year: 2022).*

*Primary Examiner* — James A Shriver, II
*Assistant Examiner* — Ian Bryce Shelton
(74) *Attorney, Agent, or Firm* — King & Partners, PLC

(57) ABSTRACT

An infant mobility scooter that enables a parent to easily soothe a fussy infant by allowing the infant to move around in a prone position on their own and/or by the parent, including: a base member, wherein the base member includes a top surface, a bottom surface, a left side wall, a right side wall, a front wall, and a rear wall; wherein a front portion of the base member is adapted to accommodate the torso, head and arms of the infant; wherein a rear portion of the base member is adapted to permit the infant's feet to slide thereover and reach a planar surface upon which the scooter is moved; and a plurality of ground engaging wheels secured to the bottom surface of the base member.

7 Claims, 13 Drawing Sheets

(56) References Cited

U.S. PATENT DOCUMENTS

| | | | | |
|---|---|---|---|---|
| 8,942,874 | B2 * | 1/2015 | Pidcoe | G05D 1/00 623/24 |
| 9,445,968 | B1 | 9/2016 | Burstein | |
| 9,693,637 | B1 * | 7/2017 | Kanzler | A47D 13/08 |
| 10,517,409 | B1 * | 12/2019 | Shoup | A47D 9/02 |
| 2002/0133881 | A1 * | 9/2002 | Vrbas | A47D 13/08 5/655 |
| 2006/0066067 | A1 * | 3/2006 | Williams | A63B 71/0009 280/87.051 |
| 2009/0031500 | A1 * | 2/2009 | Daly | A47D 13/08 5/655 |
| 2010/0319133 | A1 * | 12/2010 | Whitlock | A47D 13/08 5/655 |
| 2011/0009245 | A1 | 1/2011 | Flowers et al. | |
| 2014/0210178 | A1 * | 7/2014 | Eirin | B62K 9/00 280/274 |
| 2014/0291952 | A1 * | 10/2014 | Lehman | A47D 13/04 280/79.6 |
| 2020/0113351 | A1 * | 4/2020 | McCoy | A47D 15/003 |
| 2020/0306120 | A1 * | 10/2020 | Moreland | A47D 13/046 |

FOREIGN PATENT DOCUMENTS

| | | | | | |
|---|---|---|---|---|---|
| CN | 209047743 | U | * | 7/2019 | |
| DE | 202007014476 | U1 | * | 1/2008 | A47D 13/04 |
| EP | 2974624 | A1 | * | 1/2016 | A47D 13/08 |
| GB | 2465415 | | | 5/2010 | |
| GB | 2465415 | A | * | 5/2010 | A47D 13/04 |
| KR | 900006491 | Y1 | * | 7/1999 | |
| KR | 20120043544 | A | * | 5/2012 | |
| KR | 20160097597 | A | * | 8/2016 | |
| NO | 324885 | B1 | * | 12/2007 | A47D 13/04 |
| WO | WO-8900126 | A1 | * | 1/1989 | |
| WO | WO-03053195 | A1 | * | 7/2003 | A47D 13/04 |
| WO | WO-2008138782 | A1 | * | 11/2008 | A47D 13/08 |
| WO | WO-2019150167 | A1 | * | 8/2019 | |

* cited by examiner

INFANT MOBILITY SCOOTER AND ASSOCIATED METHOD FOR SOOTHING AN INFANT USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to infant mobility devices and, more particularly, to infant mobility scooters that enable a parent to easily soothe a fussy infant by allowing the infant to move around in a prone position on their own and/or by the parent. The present invention is further directed to a method for soothing an infant using the novel mobility scooters disclosed herein.

2. Background Art

Infant mobility devices have been known in the art for years and are the subject of a plurality of patents and publications, including: U.S. Pat. No. 9,445,968 entitled "Infant Mobility Device," U.S. Pat. No. 8,942,874 entitled "Self-Initiated Prone Progressive Crawler," U.S. Pat. No. 8,038,158 entitled "Infant Crawler," U.S. Pat. No. 6,817,864 entitled "Infant Motor Skill Developmental Aid Apparatus," U.S. Pat. No. 5,333,769 entitled "Infant Carrier Apparatus and Method," U.S. Pat. No. 4,569,532 entitled "Infant Crawler," U.S. Pat. No. 3,992,023 entitled "Baby Crawler," United States Patent Application Publication Number 2014/0291952 entitled "Infant Crawling Assist Apparatus," Great Britain Patent Application Publication Number 2465415 entitled "An Infant Mobility Device for Aiding Crawling, Standing and Walking," and Chinese Patent Application Publication Number CN 201602470 entitled "Crawling Assistant Vehicle for Infant"—all of which are hereby incorporated herein by reference in their entirety including all references cited therein.

U.S. Pat. No. 9,445,968 appears to disclose a system for aiding the crawling mobility of children or young adults. The system consists of a central hub supported by four legs. The patient is enclosed in a harness which is coupled to a support cord extending through the central hub. A lifting force partially offsetting the patient's weight is supplied by tension on the support cord, which is locked relative to the central hub via a locking device. Coupling between the support cord and harness is provided by carabineers which are clipped to "D" rings on the harness. The balance point can be adjusted by moving the attachment point to various "D" ring locations.

U.S. Pat. No. 8,942,874 appears to disclose a self-initiated prone progressive crawler facilitates crawling in infants by sensing the infant's intent and assisting movement. The device is designed as a mobility aid to assist an infant in prone locomotion. The infant can be placed in a prone position on a platform and secured with hook and loop straps. The arms and legs are unconstrained and are able to reach the floor comfortably. The self-initiated prone progressive crawler is a motorized wheeled platform which has three points of contact with the ground. One point is an industrial trackball, mounted upside down to provide positional and positional derivative data to a controller. It is located roughly under the chest of the infant and is highly sensitive to movement. The other points of contact are two DC torque motors which are controlled by the controller. In addition to the positional and positional derivative data provided to the controller, the controller also receives data from four equally spaced load cells on a force plate and tri-axial accelerometer gyros attached to the upper and lower extremities of the child. The load cells provide force information between the infant and the device to allow weight shifts to be assessed and used as a control parameter. The accelerometer gyros generate data that provides patterns that can be correlated with crawling movements.

U.S. Pat. No. 8,038,158 appears to disclose an infant crawler that includes a cover which can take many shapes, such as an animal shape or vehicle shape, secured to a wheeled crawler frame. The crawler frame can be moved around by an infant positioned in the crawler frame and the cover at least partially covers the infant positioned in the frame. The cover can include various pieces secured to various parts of the frame or can be or include a single piece removably secured to the frame. The crawler frame can be collapsible for easy transport and storage and can have a body supporting surface adjustable in height above the floor so can be adjusted for the particular user and for a particular user as the user grows to support the user at a proper height above the floor for the desired crawling action. In addition, the crawler frame can be length adjustable for adjustment as the user grows.

U.S. Pat. No. 6,817,864 appears to disclose an infant motor skill developmental aid apparatus, which includes a support base having a planar top surface and a bottom surface, a top tray having an opening for accepting an infant upper body, and a connection means connected between the support base and the top tray. Further disclosed is a method of assisting infant motor skill development, which includes providing the infant motor skill developmental aid apparatus; placing an infant inside the apparatus through the opening of the top tray and having the infant sitting on the support base with arms on top of the top tray; adjusting the top tray to an appropriate height depending on the infant age; and having the infant playing inside the apparatus for a period of time. The apparatus and the method enhance infant's acquisition of normal motor and early learning skills.

U.S. Pat. No. 5,333,769 appears to disclose an infant carrier configured to serve also as a diaper bag, bassinet, and changing surface for an infant. Adjustable straps securely support the infant carrier when the straps are worn across the body and over the shoulder of the person. The infant carrier is configured as a bassinet having raised sidewalls and a cover releasably engaged to the upper edge of the sidewalls, the cover thereby being held in spaced relationship to the bed. The cover and foot sidewall are configured to be opened outwardly from the bassinet and oriented in a position that is coplanar to the bed thereby creating a changing surface. The infant carrier includes various pockets in the foot sidewall and cover to thereby incorporate the features of a diaper bag into the infant carrier. The entire body of the infant carrier is constructed of a fabric that is washable. A support board is received in a pocket beneath the bed to provide the proper support for the bed.

U.S. Pat. No. 4,569,532 appears to disclose an infant crawler that is used to assist infants in learning to walk, wherein the infant is supported by a central frame in a generally forwardly inclined position at a height whereat the infant's feet can reach the floor, so that the infant may move the crawler by pushing with its foot action. The torso of the infant is supported in a generally forwardly inclined position, so that the infant's strength and attention are not diverted from the process of learning leg and foot movement, to the necessity for supporting and coordinating the upper body. In a preferred embodiment, the central frame includes a forwardly and upwardly inclined torso support, and a rearwardly and upwardly inclined seat disposed behind the torso support. This central frame is in turn supported by four legs providing a wide base to avoid tipping, and having wheels on the ends so that the infant crawler may be pushed about by the infant. A belt is also preferably provided to fix the infant to the central frame.

U.S. Pat. No. 3,992,023 appears to disclose a crawler type vehicle for aiding a baby trying to creep, the device consists of a seating or cushion upon which the baby is placed resting upon his abdomen, the seating or cushion is supported upon rollable wheels so that when the child pushes against the floor with his hands and feet, the crawler device supports the weight of the baby so to make it easier for him to move or travel.

United States Patent Application Publication Number 2014/0291952 appears to disclose a device for facilitating babies learning to crawl. The device includes a padded U-shaped frame and a set of wheels attached thereunder. The U-shaped frame includes a set of stabilizing rods at opposite ends to prevent a baby from falling to one side while using the device. The U-shaped frame also includes a strap assembly adapted to fasten around the baby's waist. The strap assembly comprises a fabric strap and a fastener to hold the baby in place on the padding disposed on the inner surface of the U-shaped frame. The wheels allow the baby to move across a surface while the baby simulates a crawling motion. The present device facilitates babies in developing coordination and balance while helping them to crawl.

Great Britain Patent Application Publication Number 2465415 appears to disclose an infant mobility device for aiding crawling, standing and walking that comprises first and second sections joined by a hinge, relative rotation of the sections enables a first crawling configuration, and a second standing and walking configuration. The device comprises a pair of fixed wheels and a pair of moveable wheels, a safety harness, and cushioning and a harness for the crawling baby. The device further comprises a cavity which allows for storage.

Chinese Patent Application Publication Number CN 201602470 appears to disclose a crawling assistant vehicle for an infant, in particular to an assisting instrument for infants to learn how to crawl. The crawling assistant vehicle for the infant comprises universal wheels, a central frame and hanging strips, wherein the hanging strips, four supporting frames and the universal wheels are arranged on the central frame, the universal wheels are respectively arranged at the bottom end of each supporting frame, length regulators are arranged on the hanging strips, the hanging strips and the length regulators are connected on the central frame, the four supporting frames form a cross-shaped crawling assistant vehicle which is bound at the waist of the infant by the hanging strips, so that the infant can easily and freely crawl in any direction without any limitation. The crawling assistant vehicle for the infant has the advantages of simple structure and convenient operation, the infant can easily and freely crawl, and the body of the infant is lifted by the crawling assistant vehicle for the infant, so that the infant can freely crawl in any direction without any limitation, therefore, the crawling assistant vehicle for the infant lightens the labor intensity for taking care of the infant, and is the assistant equipment widely used for the infant to freely crawl.

While the above-identified patents and publications do appear to disclose various infant mobility devices, their configurations remain non-desirous and/or problematic inasmuch as, among other things, none of the above-identified infant mobility devices appear to disclose an infant mobility scooter that enables a parent to easily soothe a fussy infant by allowing the infant to move around in a prone position on their own and/or by the parent.

These and other objects of the present invention will become apparent in light of the present specification, claims, and drawings.

SUMMARY OF THE INVENTION

The present invention is directed to an infant mobility scooter, comprising, consisting essentially of and/or consisting of: (a) a base member, wherein the base member includes a top surface, a bottom surface, a left side wall, a right side wall, a front wall, and a rear wall; (b) wherein a front portion of the base member is adapted to accommodate the torso, head and arms of the infant; (c) wherein a rear portion of the base member is adapted to permit the infant's feet to slide thereover and reach a planar surface upon which the scooter is moved; and (d) a plurality of ground engaging wheels secured to the bottom surface of the base member.

The present invention is further directed to an infant mobility scooter, comprising, consisting essentially of and/or consisting of: (a) a base member, wherein the base member includes a top surface, a bottom surface, a left side wall, a right side wall, a front wall, and a rear wall; (b) wherein a central portion of the base member is adapted to accommodate the torso, head, arms, and legs of the infant; (c) wherein a rear portion of the base member is adapted to permit the infant's feet to slide over the rear wall and reach a planar surface upon which the scooter is moved; and (d) a plurality of ground engaging wheels secured to the bottom surface of the base member.

In a preferred embodiment of the present invention, the infant mobility scooter includes a top surface that is continuous and planar and/or non-continuous and concave.

In another preferred embodiment of the present invention, the infant mobility scooter further comprises a pillow positioned on the top surface. In this embodiment, the pillow preferably comprises a boppy type pillow or newborn lounger.

In one embodiment of the present invention, the infant mobility scooter includes a plurality of wheels that consists of two wheels secured to the bottom surface of the base member proximate the front portion and one wheel secured to the bottom surface of the base member proximate the rear portion.

In another preferred embodiment of the present invention, the infant mobility scooter includes a plurality of wheels that consists of four wheels.

In yet another preferred embodiment of the present invention, the base member of the infant mobility scooter is fabricated from a metal, a metal alloy, a natural resin, a synthetic resin, a plastic, a composite, wood, and/or combinations thereof.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
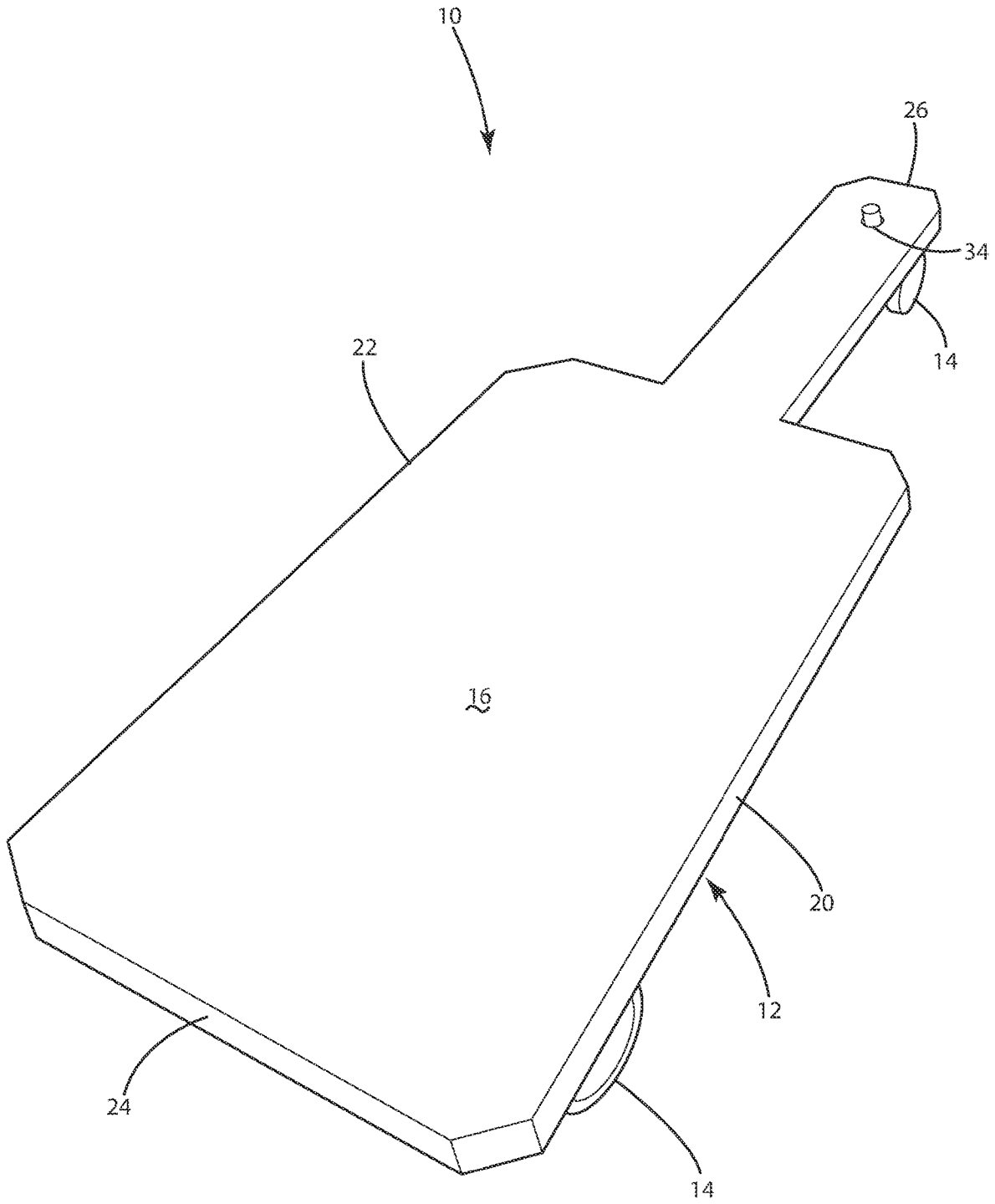
Figure 2:
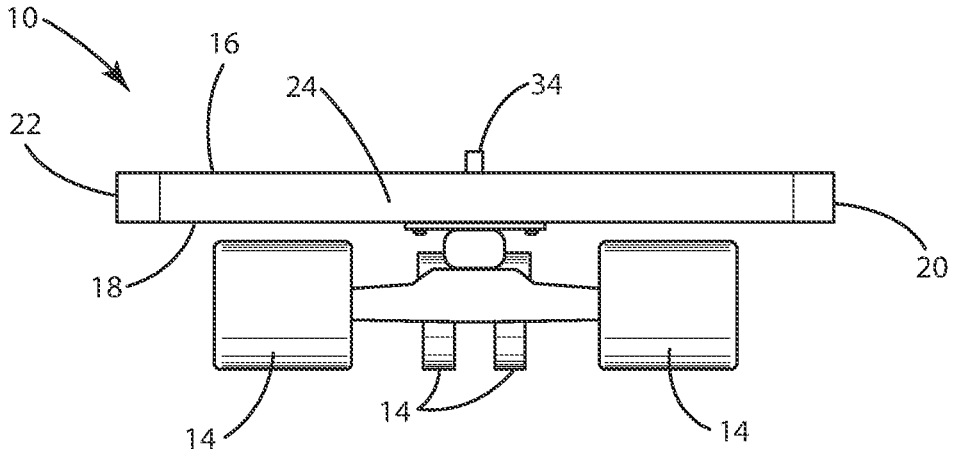
Figure 3:
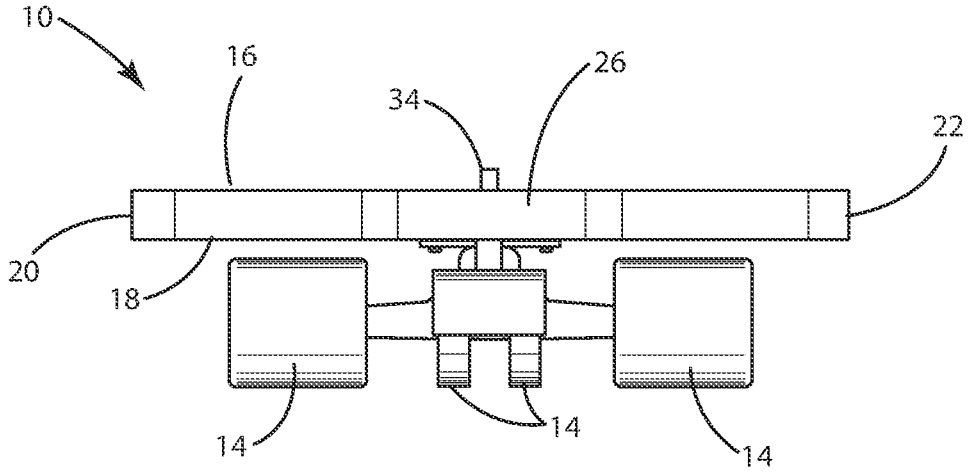
Figure 4:
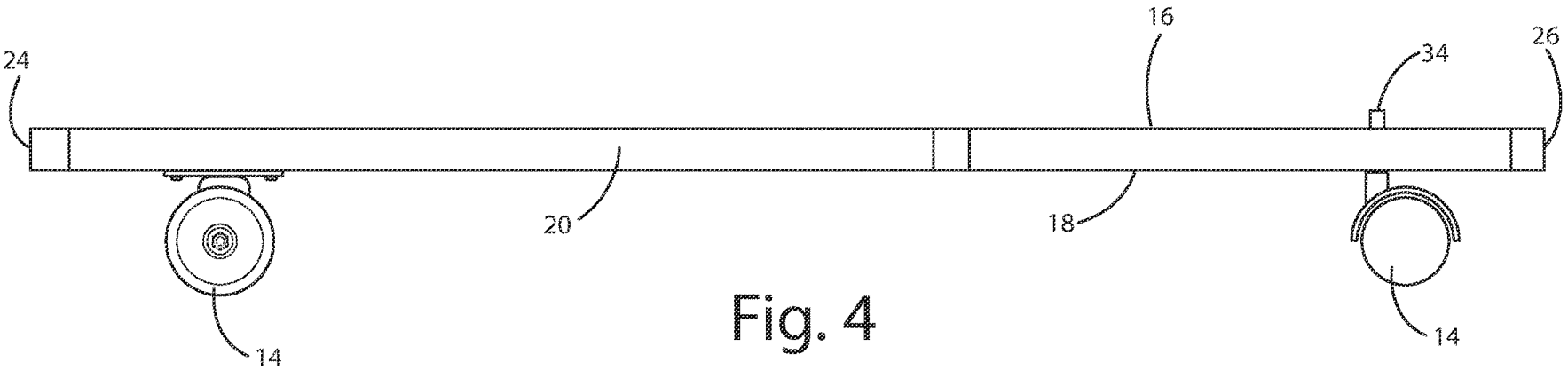
Figure 5:
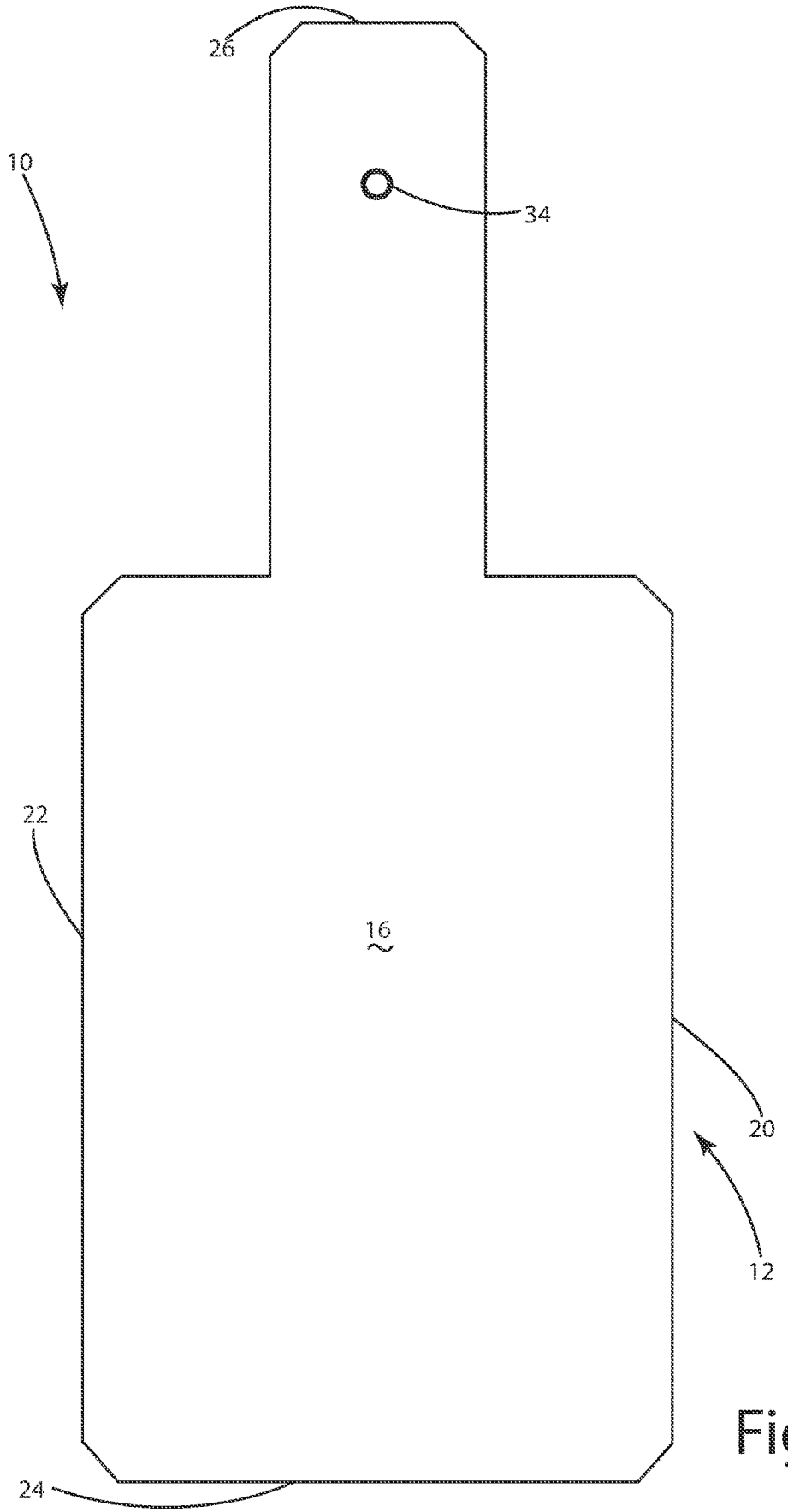
Figure 6:
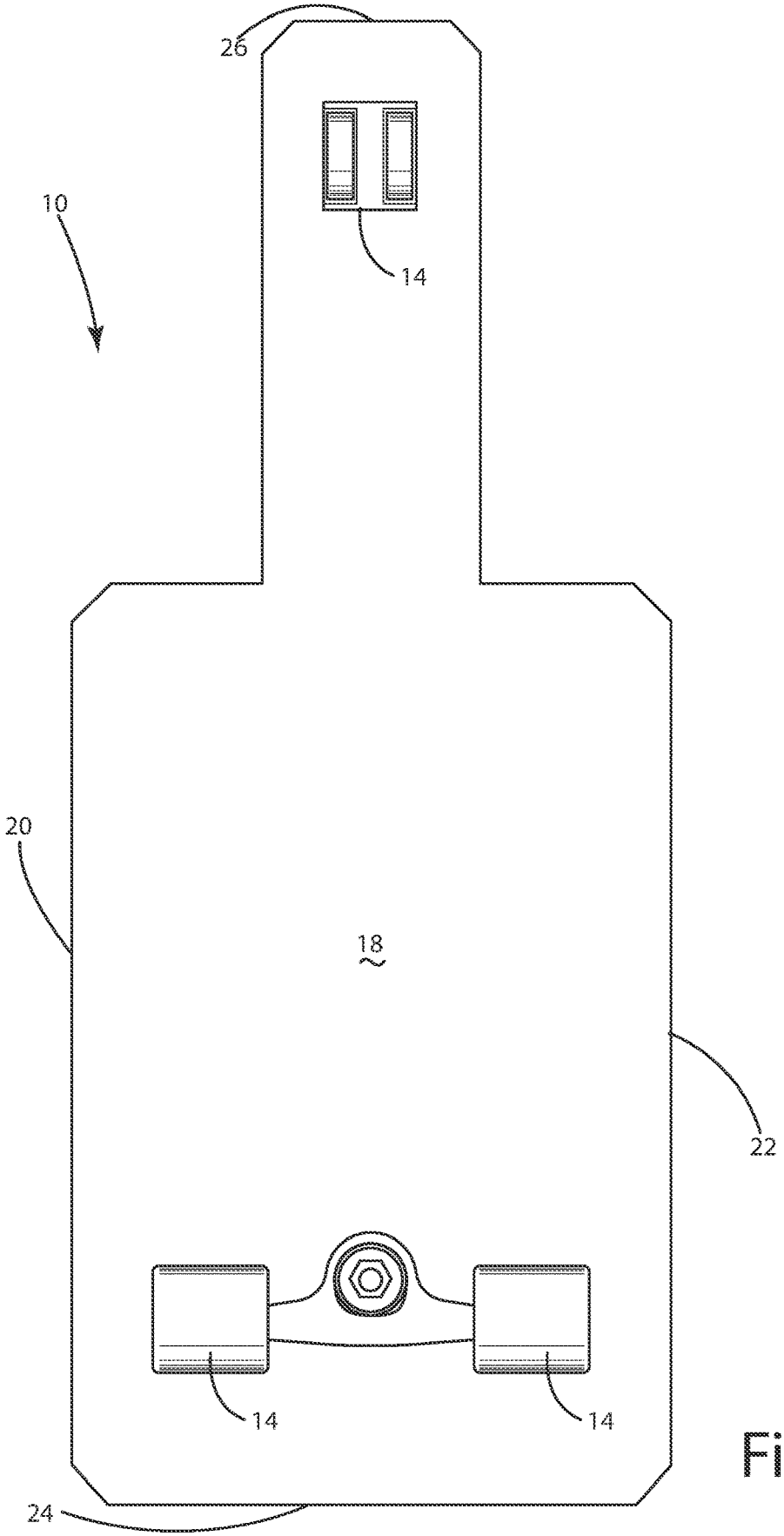
Figure 7:
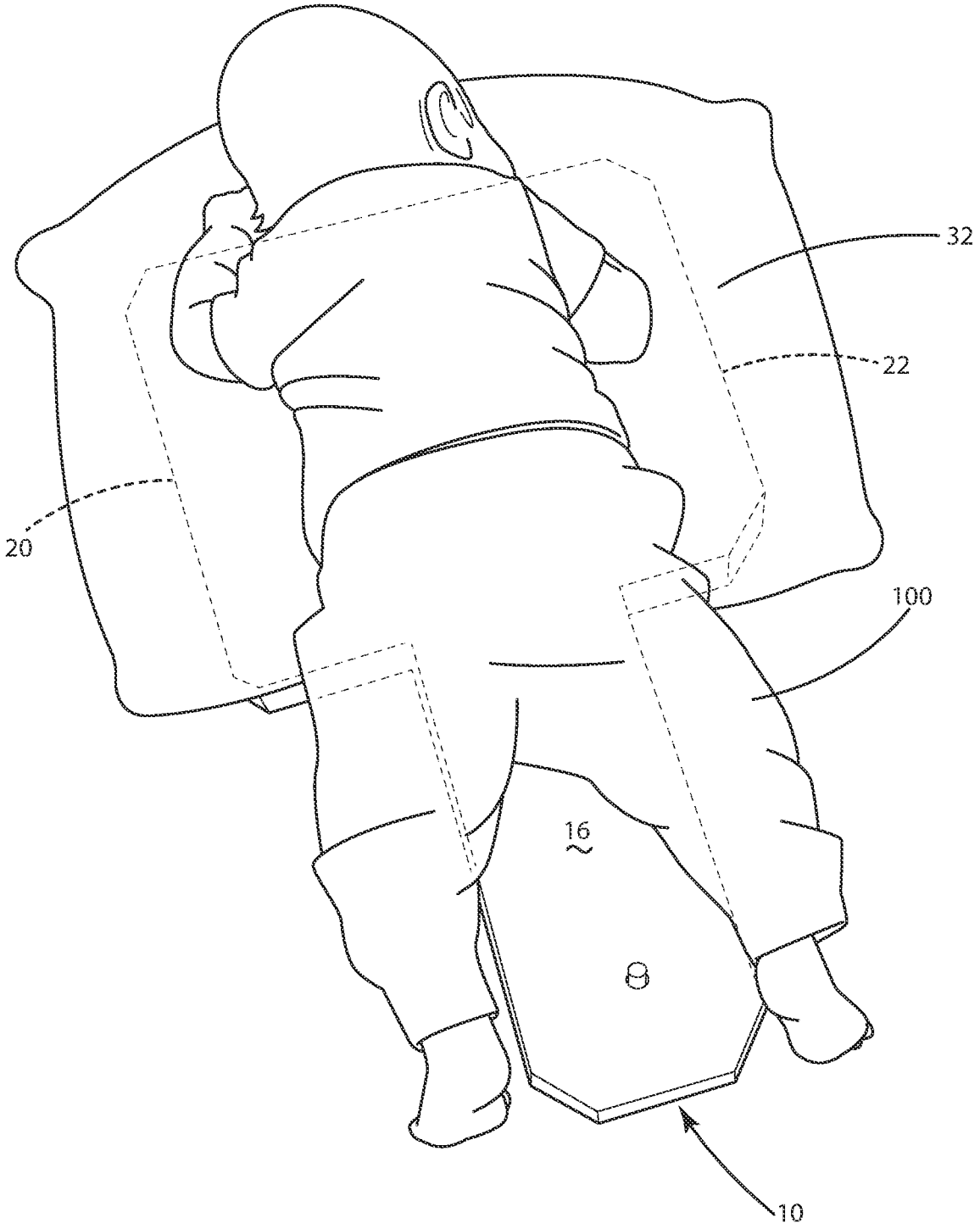
Figure 8:
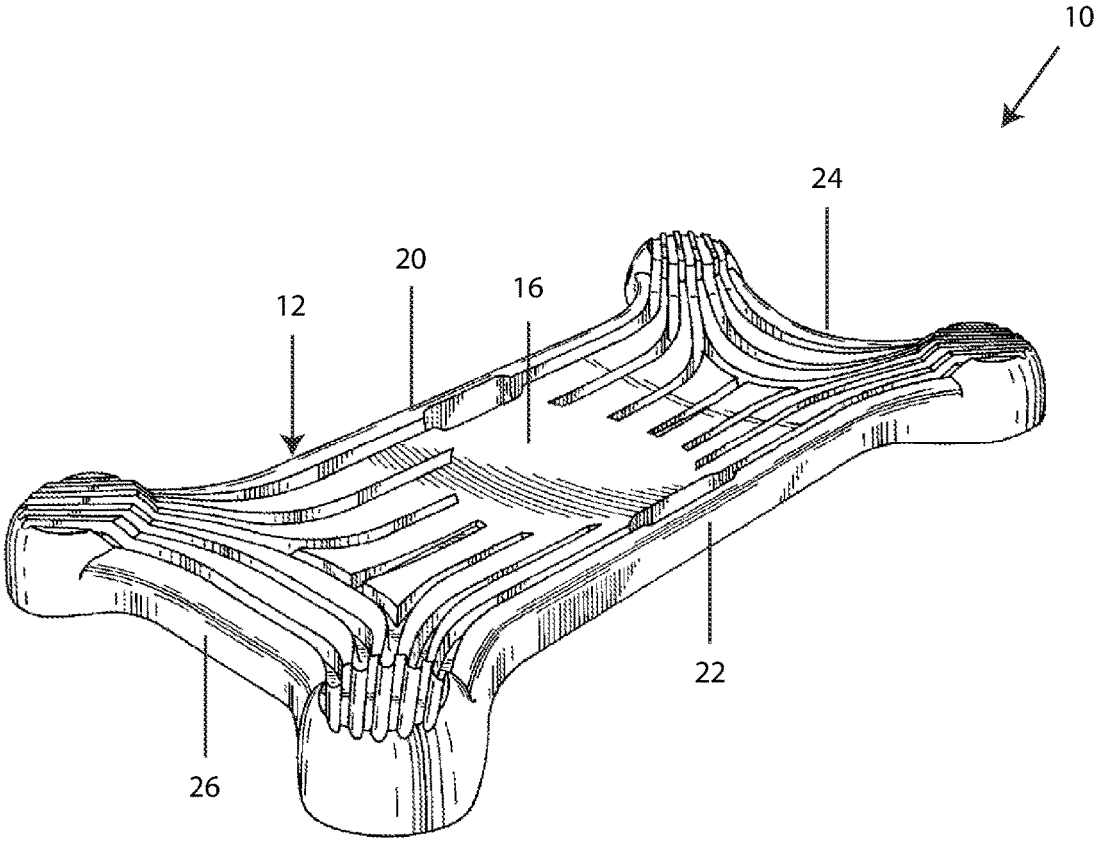
Figure 9:
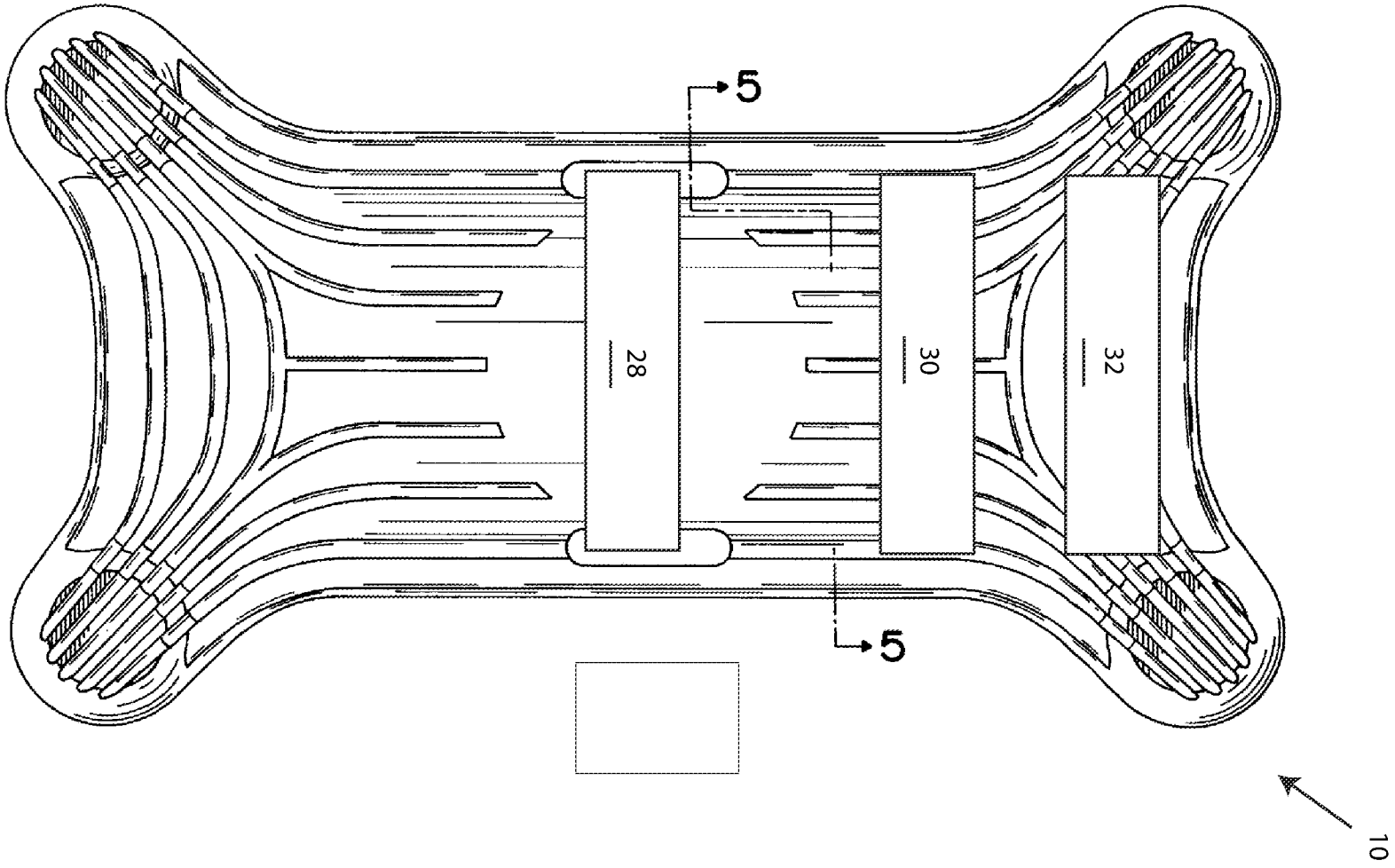
Figure 10:
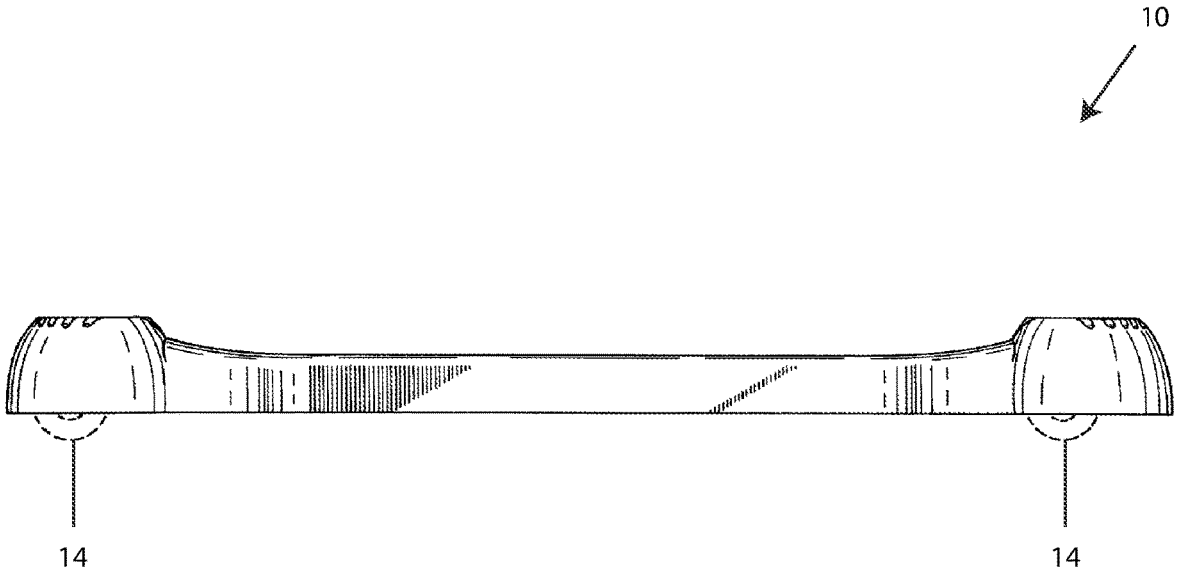
Figure 11:
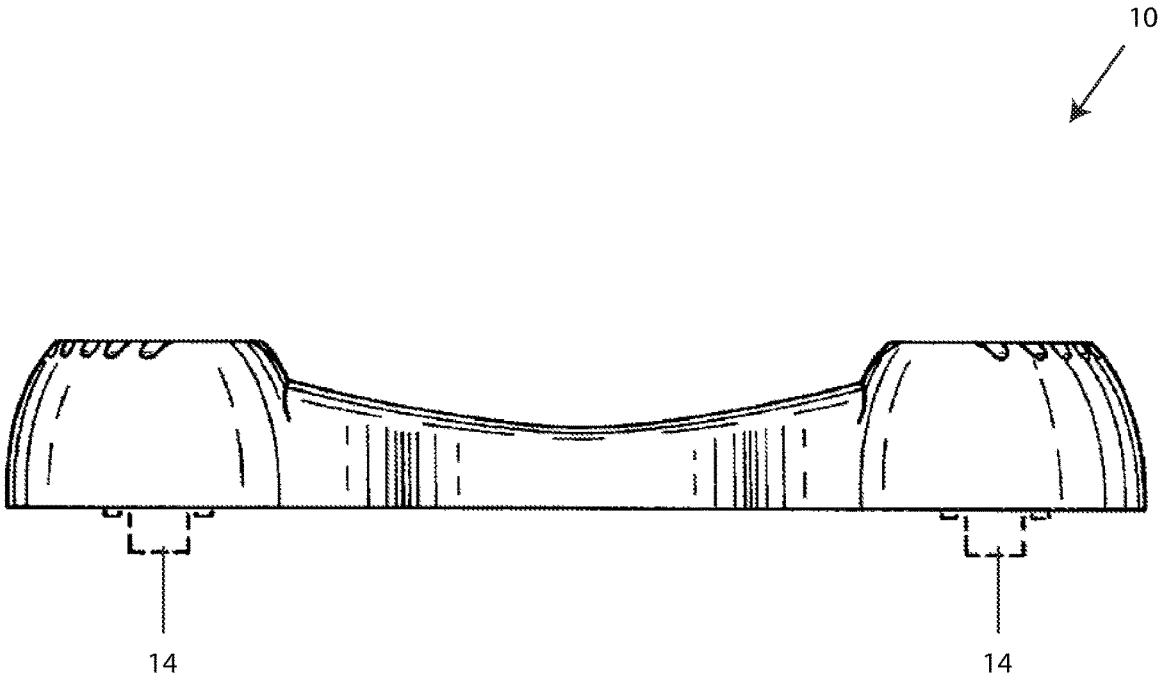
Figure 12:
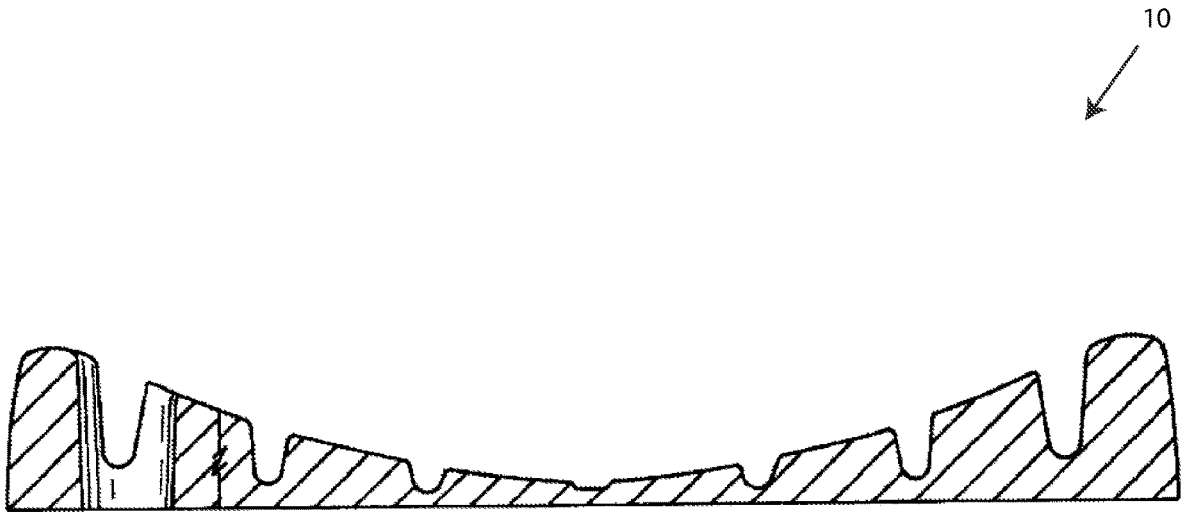
Figure 13:
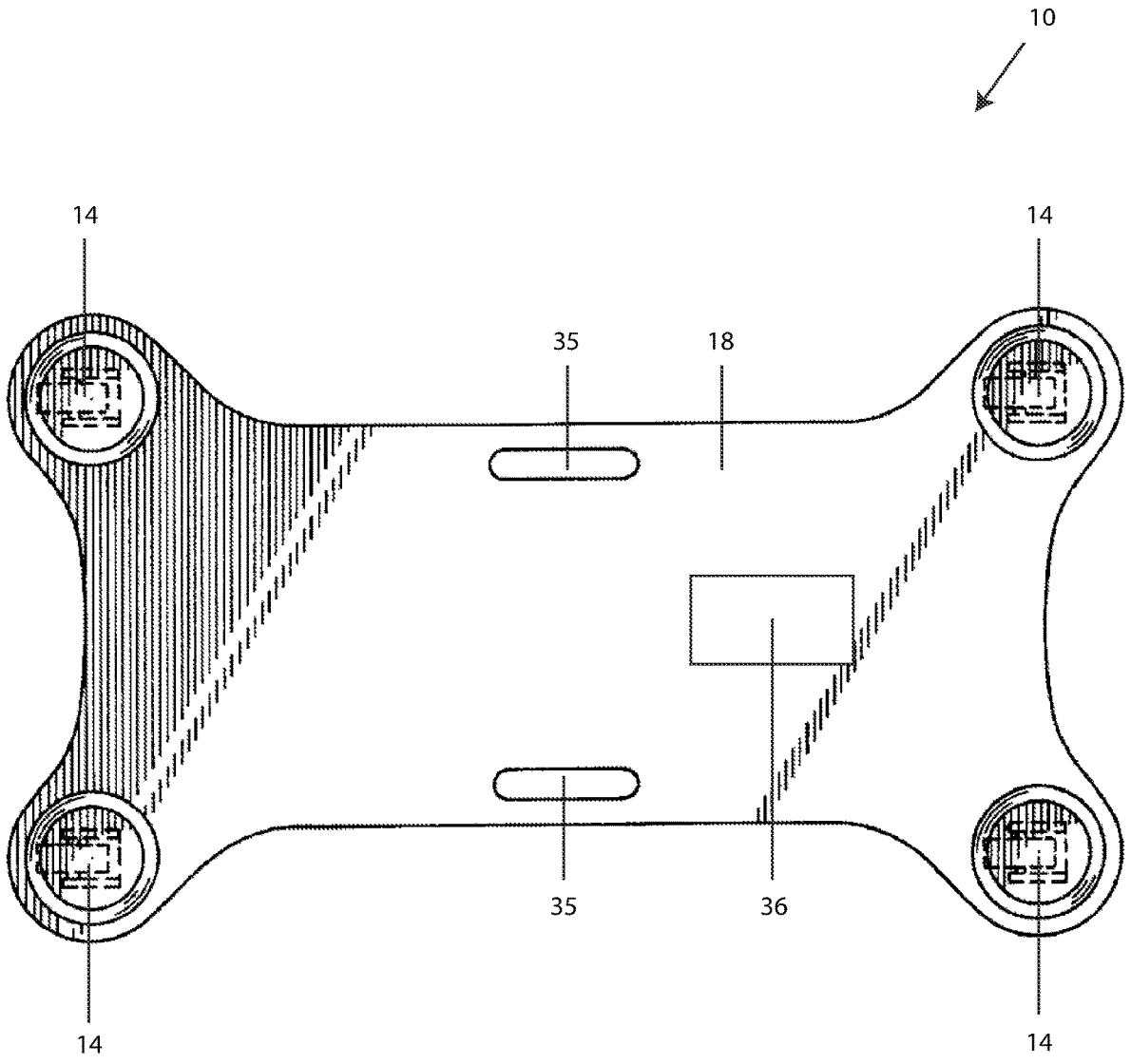
Figure 14:
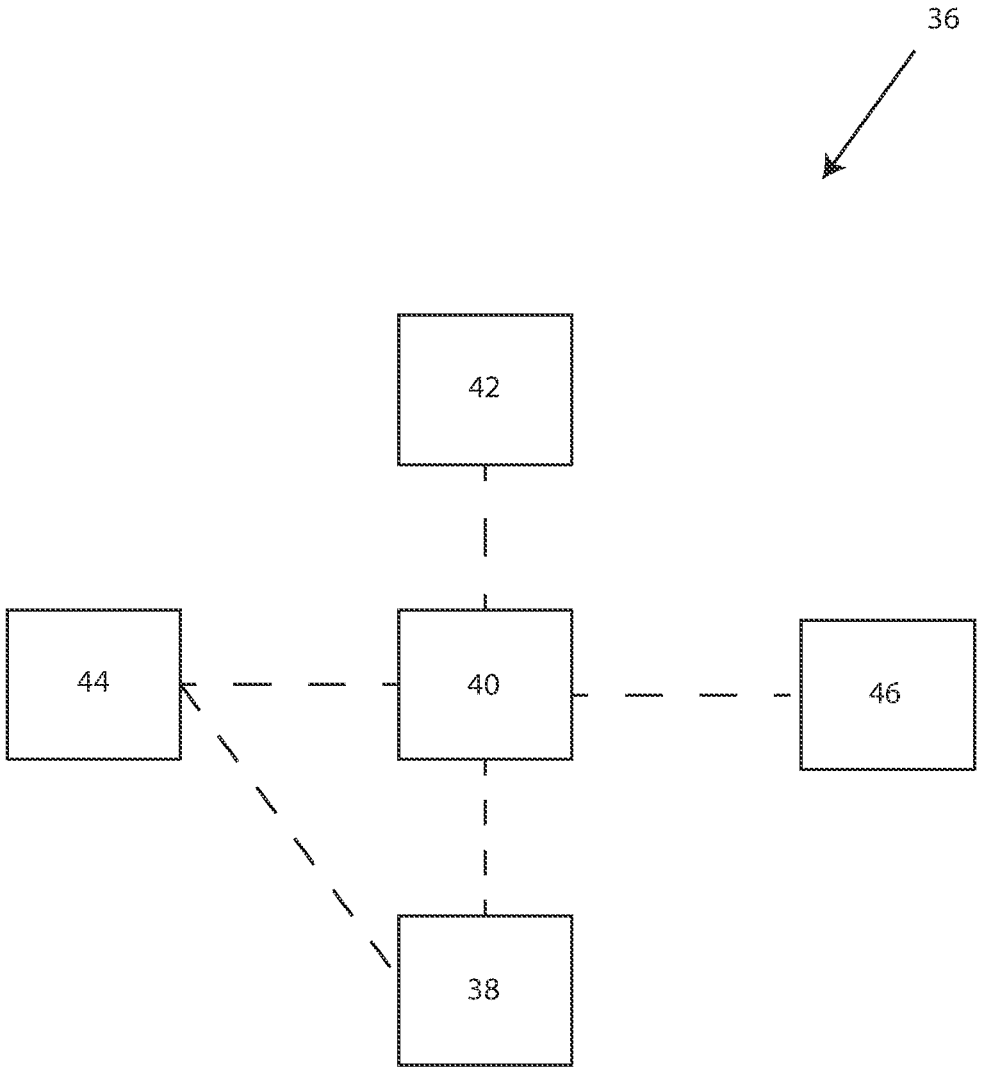

The invention will now be described with reference to the drawings wherein:

FIG. 1 of the drawings is a perspective view of an infant mobility scooter in accordance with the present invention;

FIG. 2 of the drawings is a front view of the infant mobility scooter of FIG. 1;

FIG. 3 of the drawings is a rear view of the infant mobility scooter of FIG. 1;

FIG. 4 of the drawings is a side view of the infant mobility scooter of FIG. 1;

FIG. 5 of the drawings is a top view of the infant mobility scooter of FIG. 1;

FIG. 6 of the drawings is a bottom view of the infant mobility scooter of FIG. 1;

FIG. 7 of the drawings is a perspective view of the infant mobility scooter being used by an infant;

FIG. 8 of the drawings is a perspective view of an infant mobility scooter in accordance with the present invention;

FIG. 9 of the drawings is a top view of the infant mobility scooter of FIG. 8;

FIG. 10 of the drawings is a side view of the infant mobility scooter of FIG. 8;

FIG. 11 of the drawings is a front view of the infant mobility scooter of FIG. 8;

FIG. 12 of the drawings is a cross-sectional view of the infant mobility scooter taken along line 5 of FIG. 9;

FIG. 13 of the drawings is a bottom view of the infant mobility scooter of FIG. 8; and FIG. 14 of the drawings is schematic representation of an electronics assembly for use in accordance with the present invention.

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-7 in particular, infant mobility scooter 10, is shown, in a first embodiment, as generally comprising base member 12 and plurality of ground engaging wheels 14.

In accordance with the present invention, infant mobility scooter 10 allows an individual (e.g., parent, friend, babysitter, etcetera) to easily soothe fussy infant 100 by allowing the infant to move around in a prone position on their own and/or by the parent.

Base member 12 preferably includes top surface 16, bottom surface 18, left side wall 20, right side wall 22, front wall 24, and rear wall 26. In this embodiment (See FIG. 7), a front portion of the base member is adapted to accommodate the torso, head and arms of the infant, and a rear portion of the base member is adapted to permit the infant's feet to slide thereover and reach a planar surface (e.g. floor) upon which infant mobility scooter 10 is moved. The rear portion is also adapted to receive/accommodate a foot from a parent so that infant mobility scooter 10 can be easily and gently rocked back and forth to soothe the infant. As is best shown in FIG. 1, in this embodiment, top surface 16 is continuous and planar. In other embodiments, top surface 16 is non-continuous and concave (See FIG. 8).

Base member 12 is preferably is fabricated from a metal, a metal alloy, a natural resin, a synthetic resin, a plastic, a composite, wood, and/or combinations thereof.

As is best shown in FIG. 6, infant mobility scooter 10 includes one or more (e.g., 1, 2, 3, 4, 5, 6, etcetera) ground engaging wheels 14, such as, but not limited to, free-swiveling caster wheels. In this embodiment, wheels 14 preferably consist of two wheels secured to the bottom surface of the base member proximate the front portion and one wheel secured to the bottom surface of the base member proximate the rear portion. Preferably, the front wheels are connected to one another via an axle that pivots laterally or side-to-side, and the rear wheel is a free-swiveling caster wheel. In other embodiments of the present invention, the plurality of wheels 14 consists of four wheels (See FIG. 13).

As is best shown in FIGS. 9 and 13, infant mobility scooter 10 may further comprise securement member 28 (e.g., belt, strap, etcetera), burp cloth 30, pillow 32 (e.g., a boppy pillow, newborn lounger, etcetera), post 34 and/or carrying handles/securement aperture 35. Post 34 optionally includes an aperture so that string or rope can be tied so the same allowing an individual to return infant mobility scooter 10, and, in turn, the infant back to the individual.

Referring once again to the drawings, and to FIGS. 8-13 in particular, infant mobility scooter 10, is shown, in a second embodiment, as generally comprising base member 12 and plurality of ground engaging wheels 14.

In this embodiment, base member 12 preferably includes top surface 16, bottom surface 18, left side wall 20, right side wall 22, front wall 24, and rear wall 26. In this embodiment, a central portion of the base member is adapted to accommodate the torso, head, arms, and legs of the infant, and a rear portion of the base member is adapted to permit the infant's feet to slide over the rear wall and reach a planar surface upon which the scooter is moved.

Referring now to FIG. 14, in one embodiment of the present invention, infant mobility scooter 10 includes electronics assembly 36 having a box or enclosure that is preferably associated with and/or secured to bottom surface 18 of the infant mobility scooter. Electronics assembly 36 generally comprises energy source 38, circuit board/controller (e.g., printed circuit board) 40, primary user interface 42, speaker 44 and optional adjunct components 46. Electronics assembly 36 provides additional soothing support for the infant via white noise and/or calming audio output, such as a song, a tune, a lullaby, a prerecorded message from, for example, a parent or grandparent—just to name a few.

Energy source 38 is in electrical communication with circuit board 40 and speaker 44. Energy source 38 of the electronics assembly preferably comprises, for example, a primary electrochemical cell, a secondary electrochemical cell, and/or a fuel cell.

Circuit board/controller 40 is preferably in electrical communication with energy source 38, primary user interface 42, speaker 44, and any optional adjunct components 46.

In a preferred embodiment of the present invention, circuit board/controller 40 of electronics assembly 36 comprises one or more components, such as a battery, a bridge rectifier, a capacitor, a central processing unit, a communications port, a control board, a crystal, a diode, a fuse, a graphics board, an inductor, an input port, an integrated circuit, a microprocessor, a memory module, an oscillator, an output port a potentiometer, a receiver, a relay, a resistor, a semiconductor, a transformer, a transistor, a tuner, a video processing unit, a wired communications hub, and/or a wireless communications hub.

Primary user interface 42 is preferably in electrical communication with circuit board/controller 40. In one embodiment of the present invention, primary user interface 42 of electronics assembly 36 comprises a graphical user interface and/or a circuit board having a plurality of user interface buttons.

Speaker 44 of electronics assembly 36 is preferably in electrical communication with energy source 38 and/or circuit board/controller 40. Speaker 44 preferably comprises a mini-speaker and/or a micro-speaker.

The present invention is also directed to a method for soothing an infant, comprising, consisting essentially of, and/or consisting of the steps of: (a) providing an infant mobility scooter as is disclosed herein; and (b) enabling the infant to move around in a prone position on their own and/or by the parent to, in turn, soothe the infant. The method may also comprise using an electronics assembly as disclosed herein to generate a soothing audio output to further enhance the infant's soothing experience.

In another embodiment of the present invention, electronics assembly 36 further comprises one or more optional adjunct components 46, such as a secondary energy source, a light source, a secondary user interface, a secondary circuit board, a secondary speaker, a vibration mechanism, a white noise generator, a thermo sensor, a tactile sensor, and/or a display—all of which are preferably in electrical communication with circuit board/controller 40.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. An infant mobility scooter that enables a parent to easily soothe a fussy infant by allowing the infant to move around in a prone position on their own and/or by the parent, comprising:

a base member, wherein the base member includes a top surface, a bottom surface, a left side wall, a right side wall, a front wall, and a rear wall, wherein the front wall is planar and wherein the left and right side walls are void of longitudinal boards and vertical shaped members and wherein the rear wall is void of a transversal board, and wherein the top surface is the uppermost surface of the infant mobility scooter;

a post secured to the base member, wherein the post is upright and extends above the top surface of the base member, and wherein the post includes an aperture so that string or rope can be tied to the same allowing an individual to return the infant mobility scooter to the individual;

wherein a front portion of the base member is adapted to accommodate the torso, head and arms of the infant;

wherein a rear portion of the base member is adapted to permit the infant's feet to slide thereover and reach a planar surface upon which the scooter is moved; and a plurality of ground engaging wheels secured to the bottom surface of the base member, wherein the plurality of wheels consists of two non-free rotating wheels which are connected to each other via a pivotable truck and secured to the bottom surface of the base member proximate the front portion and one free rotating wheel secured to the bottom surface of the base member proximate the rear portion.

2. The infant mobility scooter according to claim 1, wherein the top surface is continuous and planar.

3. The infant mobility scooter according to claim 1, further comprising a pillow positioned on the top surface.

4. The infant mobility scooter according to claim 3, wherein the pillow comprises a boppy pillow or newborn lounger.

5. The infant mobility scooter according to claim 1, wherein the base member is fabricated from a metal, a metal alloy, a natural resin, a synthetic resin, a plastic, a composite, wood, and/or combinations thereof.

6. An infant mobility scooter that enables a parent to easily soothe a fussy infant by allowing the infant to move around in a prone position on their own and/or by the parent, comprising:

a base member, wherein the base member includes a top surface, a bottom surface, a left side wall, a right side wall, a front wall, and a rear wall, wherein the front wall is planar and wherein the left and right side walls are void of longitudinal boards and vertical shaped members and wherein the rear wall is void of a transversal board;

a post secured to the base member, wherein the post is upright and extends above the top surface of the base member, and wherein the post includes an aperture so that string or rope can be tied to the same allowing an individual to return the infant mobility scooter to the individual;

wherein a front portion of the base member is adapted to accommodate the torso, head and arms of the infant;

wherein a rear portion of the base member is adapted to permit the infant's feet to slide thereover and reach a planar surface upon which the scooter is moved; and a plurality of ground engaging wheels secured to the bottom surface of the base member, wherein the plurality of wheels consists of two non-free rotating wheels which are connected to each other via a truck and secured to the bottom surface of the base member proximate the front portion and one free rotating wheel secured to the bottom surface of the base member proximate the rear portion.

7. An infant mobility scooter that enables a parent to easily soothe a fussy infant by allowing the infant to move around in a prone position on their own and/or by the parent, consisting of:

a base member, wherein the base member includes a top surface, a bottom surface, a left side wall, a right side wall, a front wall, and a rear wall, wherein the front wall is planar and wherein the left and right side walls are void of longitudinal boards and vertical shaped members and wherein the rear wall is void of a transversal board;

a post secured to the base member, wherein the post is upright and extends above the top surface of the base member, and wherein the post includes an aperture so that string or rope can be tied to the same allowing an individual to return the infant mobility scooter to the individual;

wherein a front portion of the base member is adapted to accommodate the torso, head and arms of the infant;

wherein a rear portion of the base member is adapted to permit the infant's feet to slide thereover and reach a planar surface upon which the scooter is moved; and a plurality of ground engaging wheels secured to the bottom surface of the base member, wherein the plurality of wheels consists of two non-free rotating wheels which are connected to each other via a truck and secured to the bottom surface of the base member proximate the front portion and one free rotating wheel secured to the bottom surface of the base member proximate the rear portion.

* * * * *